United States Patent [19]

Mulzet

[11] Patent Number: 4,708,712

[45] Date of Patent: Nov. 24, 1987

[54] CONTINUOUS-LOOP CENTRIFUGAL SEPARATOR

[75] Inventor: Alfred P. Mulzet, Charlotte, N.C.

[73] Assignee: Cobe Laboratories, Inc., Lakewood, Colo.

[21] Appl. No.: 845,847

[22] Filed: Mar. 28, 1986

[51] Int. Cl.[4] ..... B04B 7/08

[52] U.S. Cl. ..... 494/45; 494/81

[58] Field of Search ..... 494/17, 41, 43, 45, 494/66, 81

[56] References Cited

U.S. PATENT DOCUMENTS

| | | | |
|---|---|---|---|
| 4,094,461 | 6/1978 | Kellogg et al. | 494/81 |
| 4,146,172 | 3/1979 | Cullis et al. | 494/17 |
| 4,386,730 | 6/1983 | Mulzet | 494/81 |
| 4,430,072 | 2/1984 | Kellogg et al. | 494/45 |
| 4,447,221 | 5/1984 | Mulzet | 494/45 |

*Primary Examiner*—Harvey C. Hornsby
*Assistant Examiner*—C. Reinckens

[57] ABSTRACT

Centrifuge apparatus for use in separating a heavy phase from a light phase in a rotating bowl, the apparatus comprising means defining a channel forming a continuous loop and having an inlet, a first outlet, and a dam portion spaced along the channel from the inlet and having an inner wall radius that is greater than that of adjacent portions so as to provide a heavy phase dam region which can be completely filled with separated heavy phase so as to prevent separated light phase from flowing past it.

11 Claims, 1 Drawing Figure

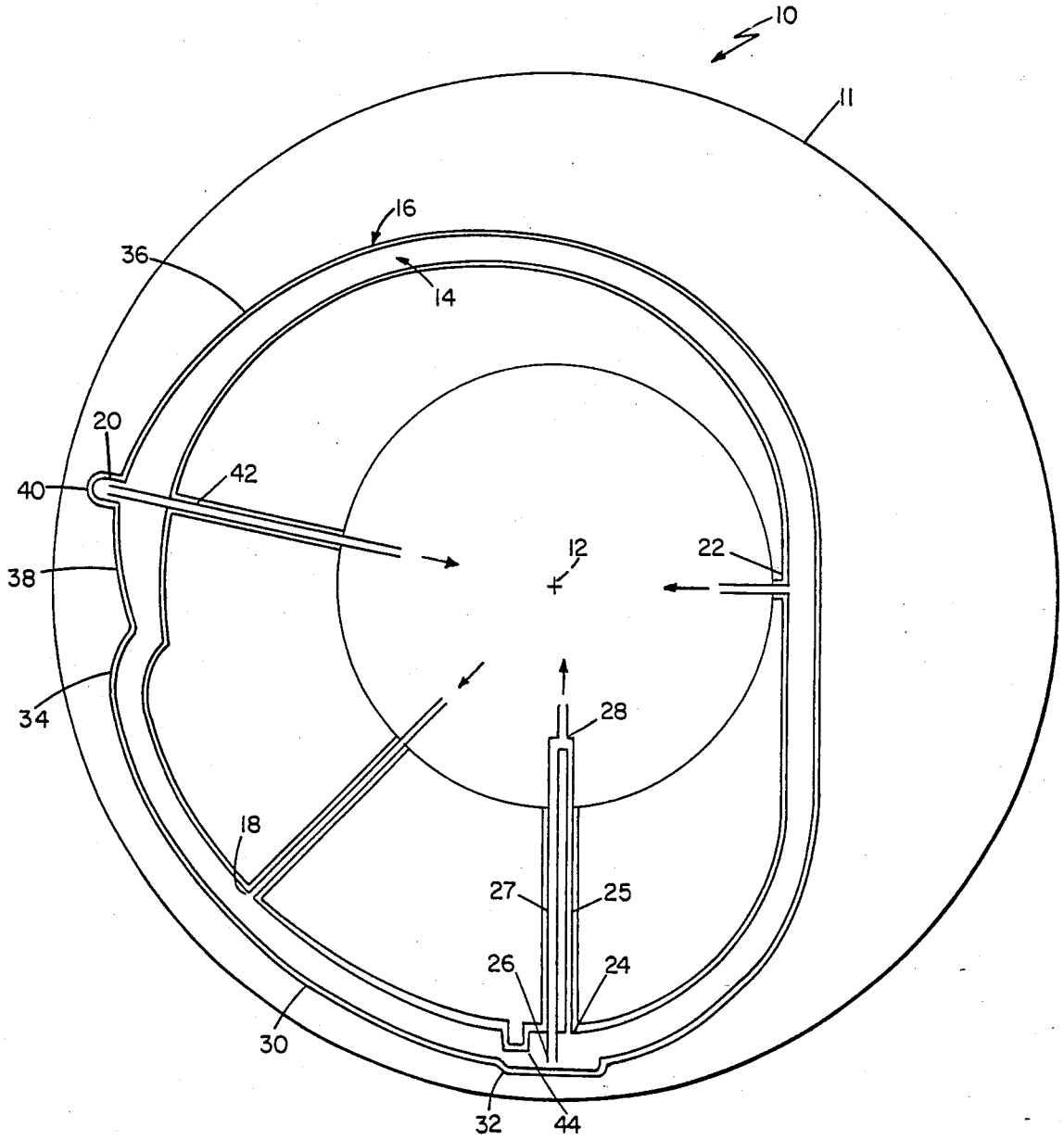
10
11
16
14
36
20
42
40
12
22
38
34
28
18
27
25
26
24
30
32
44

CONTINUOUS-LOOP CENTRIFUGAL SEPARATOR

FIELD OF THE INVENTION

The invention relates to centrifugal separators.

BACKGROUND OF THE INVENTION

Centrifugal separators, for example those used in separating blood components, can employ a disposable plastic channel that is fitted within a centrifuge bowl driven by a motor. These channels typically have a beginning with an inlet for whole blood and an end where most of the separated components are removed by separate outlets, the beginning and the end being located next to each other but isolated from each by a plastic wall preventing mixing of the incoming liquid with that at the end of the channel.

For example, Kellogg et al. U.S. Pat. No. 4,094,461 discloses a single-stage, blood separation channel of generally constant radius in which a whole blood inlet is provided at the beginning and all of the separated components are removed from a collection chamber at the end of the channel, the beginning and end being separated by a wall. In the collection chamber, a dam is placed behind a white cell/platelet outlet to block flow past it of the white cells and platelets of interest but to permit flow of the heavier red cells and lighter plasma. On the other side of the dam, an interface positioning outlet is provided for the purpose of maintaining the position of the interface between the red cells and plasma in order to control the position of the thin white cell/platelet layer at the white cell/platelet outlet to provide efficient white cell/platelet removal.

In my U.S. Pat. No. 4,386,730, there is shown a two-stage separation channel having a constant-radius first-stage separation portion wherein the separated red blood cells flow along the outer wall back toward an outlet near the beginning of the channel, and the platelets and plasma continue beyond the first-stage portion, through a transition portion with a decreasing-radius outer wall, and into a radially-increasing second-stage separation portion with a plasma outlet and a platelet outlet at its end. Once again the beginning and the end of the channel are separated from each other by a wall. In operation, it is necessary that the interface between the red blood cells and the separated plasma and platelets be maintained at the transition portion by continuous monitoring and adjusting of flowrates by an operator.

SUMMARY OF THE INVENTION

I have discovered that a centrifugal separator for separating a heavy phase from a light phase can be advantageously provided with a separation channel that forms a continuous loop and prevents flow of light phase from one portion to another by a dam portion having an inner wall radius that is greater than that of adjacent portions, so that the heavy phase will completely fill the channel there.

In preferred embodiments, the separator is a two-stage blood separator for separating red blood cells, platelets, and plasma, and an interface positioning outlet is provided on the other side of the dam portion from a transition portion between the first- and second-stage separation portions; there is a plasma outlet at a radially most inward position of the channel, thereby removing any air in the channel; and the second-stage separation portion increases in outer wall radius and in cross-sectional area from the transition portion to a platelet collection outlet. Such a separator is self-priming, is self-regulating, so that there is no need for operator input to maintain the interface between the red cells and the plasma, and achieves high yields of platelets.

Other advantages and features of the invention will be apparent from the following description of a preferred embodiment thereof and from the claims.

DESCRIPTION OF THE PREFERRED EMBODIMENT

The drawing will be described first.

Drawing

The drawing is a diagrammatic plan view of a rotor bowl and a disposable separation channel of centrifuge apparatus according to the invention.

Structure

Referring to the drawing, there is shown centrifuge apparatus 10 including bowl 11, mounted for rotation about an axis indicated at 12, and removable plastic channel 14 in groove 16 of bowl 11. Channel 14 forms a continuous loop and has whole blood inlet 18, platelet collection outlet 20, plasma outlet 22, interface positioning outlet 24 and red/white blood cell outlet 26. Combined red cells and white cells constitute a heavy phase; the lighter plasma constitutes a light phase, and the intermediate density platelets constitute an intermediate phase. Tubes 25, 27, for interface positioning outlet 24 and red/white blood cell outlet 26, respectively, are joined together at junction 28.

Channel 14 includes first-stage separation portion 30, between dam portion 32 and transition portion 34, and second stage-separation portion 36, between transition portion 34 and plasma outlet 22. First-stage separation portion 30 decreases slightly in radius from dam portion 32 to transition portion 34. Transition portion 34 has a sharply decreasing radius, and the range of radii of its outer wall includes a radius of equal value to that of interface positioning outlet 24.

Second-stage separation portion 36 includes an increasing cross-sectional area portion 38 having a generally constant radius inner wall and an increasing radius outer wall ending at platelet collection well 40, in which is located the end of platelet tube 42 providing platelet collection outlet 20. The remainder of second-stage separation portion 36 decreases in cross-sectional area and in radius from platelet collection well 40 to plasma outlet 22, which is at the smallest radius of any portion of channel 14.

Dam portion 32 has an inner wall with a radius that is larger than the radius of the channel at both sides of it. This provides a region which can be completely filled by the separated heavy phase, here red and white blood cells, thereby preventing flow of the lighter phase, here combined plasma and platelets on the left side and plasma on the right side, past it. Dam portion 32 includes dam 44 that abruptly extends radially outward from its inner wall.

The tubes connected to inlet 18, outlets 20, 22, and junction 28 are connected to a seal-less multichannel rotation connection means (not shown) of the well-known type shown, for example, in U.S. Pat. No. 4,146,172.

Operation

In operation, a new disposable channel 14 and its associated tubes are installed in rotor bowl 11 when the centrifuge apparatus is being used with a new patient. Channel 14 is first primed by having centrifuge bowl 10 run at a low RPM as saline solution is introduced through inlet 18. As saline solution fills channel 14, the air is forced radially inward and removed via plasma outlet 22. All air bubbles are removed because all portions of channel 14 are more radially outward than plasma outlet 22.

After all the air has been cleared, the bowl rotation speed is increased to the operation speed, and blood is introduced into channel 14 via inlet 18. Initially, all outflow is removed via plasma outlet 22, so that the saline solution can be removed and discarded. After processing a fixed volume of blood, all saline will have been removed, and the rate of removal of plasma through plasma outlet 22 is reduced. This flow is maintained to assure that any air or low density fluid that is introduced into channel 14 is immediately removed. The flow into inlet 18 is approximately 30 ml/min; flow through platelet outlet 20 is approximately 2 or 3 ml/min; flow through junction 28 is approximately 15 ml/min (about 2/3 of which is from red/white cell outlet 26), and the remainder is through outlet 22. The system automatically remains stable throughout the remaining procedure.

In the steady state operation, whole blood enters via inlet 18; platelets are removed via outlet 20; plasma is removed via outlet 22; red/white blood cells are removed via outlet 26, and red/white blood cells and plasma are alternately removed via outlet 24 so as to maintain the radial position of the interface between the red/white blood cells and the plasma.

The density of the incoming blood through inlet 18 into first-stage separation portion 30 is lower than the mean density in the region of inlet 18, so that the incoming blood flows clockwise in the direction of the smaller radius. Under centrifugal action, the red cells and the white cells sediment radially outward (owing to their larger density). As they do, the mean density increases so the clockwise flow of this fraction diminishes and eventually stops. The packed red and white cells then flow counterclockwise along the outer wall of portion 30 toward dam portion 32, where they are removed by outlet 26. The blood components remaining in portion 30 after separating out the red cells and the white cells are platelets and plasma. This mixture continues to flow clockwise and flows over transition portion 34 to second-stage separation portion 36. The decreasing outer wall radius at transition portion 34 acts as a dam permitting only the mixture of plasma and platelets to flow into second-stage separation portion 36. The interface between the packed red and white cells and the separated platelet and plasma mixture is maintained at a radius within the range of radii at the outer wall of transition portion 34 by interface positioning outlet 24.

In second-stage separation portion 36, the platelet and plasma mixture is subjected to a high centrifugal force for an extended period of time, and the platelets sediment radially outward until they reach the outer wall. Platelets beginning near the outer wall when entering second-stage separation portion 36 move clockwise along the outer wall into platelet collection well 40. Those that are closer to the inner wall of portion 36 continue sedimenting radially outward in the decreasing cross-sectional area portion of portion 36 until they reach the outer wall of the chamber and then reverse their direction of flow and slide counter-clockwise down the outer wall to collection well 40 for removal. The remaining plasma, with a very low platelet concentration, continues flowing clockwise. A fraction of the plasma is removed via outlet 22, and the remaining plasma flows to interface positioning outlet 24 for removal.

The interface that needs to be controlled is the interface between the packed red and white cells and the platelet and plasma mixture at transition portion 34, in order to achieve two objectives: (1) this interface cannot move too far radially inward or else the packed red cells and white cells will spill over and accumulate in platelet collection well 40, (2) the interface cannot move too far radially outward or else the platelets will separate from the incoming blood in first-stage separation portion 30, and will not flow into second-stage separation portion 36 for collection at well 40. Ideally, an interface positioning outlet should be located along channel 14 adjacent to the position at which interface control is desired. However, because the interface positioning outlet removes both plasma and red and white cells, if the interface positioning outlet were located near transition portion 34, it would remove plasma that is rich in platelets, compromising the efficiency of the device. By locating interface positioning outlet 24 at a point substantially moved from the interface to be controlled at transition portion 34, plasma that has a very low concentration of platelets can be used to regulate the interface. The distance of interface positioning outlet 24 from transition portion 34 results in a less precise location of the interface to be controlled, but it has been demonstrated that the radial location that the interface occupies falls within a band that assures good performance and without removal of platelets.

Other Embodiments

Other embodiments of the invention are within the scope of the following claims.

What is claimed is:

1. Centrifuge apparatus for use in separating a heavy phase from a light phase in a rotating bowl, said apparatus comprising means defining a closed channel forming a continuous open loop so as to permit uninterrupted flow of liquid therearound in both directions without a barrier and having an inlet, a first outlet, and a dam portion spaced along said channel from said inlet and having an inner wall radius that is greater than that of adjacent portions so as to provide a heavy phase dam region which can be completely filled with separated heavy phase so as to prevent separated light phase from flowing past it.

2. The apparatus of claim 1 wherein said apparatus is for use in separating an intermediate phase in addition to said heavy and light phases and includes a second outlet at a different radial position than said first outlet.

3. The apparatus of claim 2 wherein said channel has a first-stage separation portion for separating one of said phases from the other two phases, and a second-stage separation portion that has an end communicating with one end of said first-stage separation portion and is for separating the other two phases, and wherein said dam portion is between the other end of said first-stage portion and the other end of said second-stage portion, and said inlet is on said channel between the ends of said first-stage separation portion.

4. The apparatus of claim 3 wherein said channel has a transition portion between said first- and second-stage separation portions, said transition portion including a transition wall extending over a range of radii including a radius at an interface between phases.

5. The apparatus of claim 4 wherein said transition wall is an outer wall with a radius that decreases from said first-stage separation portion to said second-stage separation portion, said first outlet is for removal of heavy phase and is in the portion including said first-stage separation portion and said dam portion, and said second outlet is for removal of said light phase and is in said second-stage separation portion at a radius smaller than that of said first outlet, and there is a third outlet for removal of said intermediate phase in said second-stage separation portion, and further comprising interface means for controlling the interface between the light phase and the heavy phase at a position along said channel on the other side of said dam from said transition portion so as to maintain the inner boundary of said heavy phase within said range of radii.

6. The apparatus of claim 5 wherein said interface means comprises an interface positioning outlet at a radius within said range and shaped to provide a different flowrate for said light phase than for said heavy phase.

7. The apparatus of claim 6 wherein there is a tube connected to said interface positioning outlet, and a tube connected to said first outlet, and said tubes are connected together.

8. The apparatus of claim 5 wherein the radius at said second outlet is the shortest radius of said channel, whereby any air in said channel travels to, and is removed at, said second outlet.

9. The apparatus of claim 5 wherein said second-stage portion has an outer wall that increases in radius from said transition portion to said third outlet.

10. The apparatus of claim 9 wherein said second-stage separation portion increases in cross-sectional area from said transition portion to said third outlet.

11. The assembly of claim 10 wherein said second-stage portion decreases in cross-sectional area on the other side of said third outlet.

* * * * *